US008145428B1

(12) United States Patent
Saleri et al.

(10) Patent No.: US 8,145,428 B1
(45) Date of Patent: Mar. 27, 2012

(54) ASSESSING PETROLEUM RESERVOIR RESERVES AND POTENTIAL FOR INCREASING ULTIMATE RECOVERY

(75) Inventors: Nansen G. Saleri, Houston, TX (US); Robert M. Toronyi, Houston, TX (US)

(73) Assignee: QRI Group, LLC, Houston, TX (US)

( * ) Notice: Subject to any disclaimer, the term of this patent is extended or adjusted under 35 U.S.C. 154(b) by 360 days.

(21) Appl. No.: 12/567,361

(22) Filed: Sep. 25, 2009

Related U.S. Application Data

(60) Provisional application No. 61/101,008, filed on Sep. 29, 2008.

(51) Int. Cl.
*G06F 19/00* (2011.01)

(52) U.S. Cl. ..... 702/9

(58) Field of Classification Search ... 702/9; 166/252.1, 166/268
See application file for complete search history.

(56) References Cited

U.S. PATENT DOCUMENTS

| | | | | |
|---|---|---|---|---|
| 3,035,440 | A | 5/1962 | Reed | |
| 7,445,041 | B2 | 11/2008 | O'Brien | |
| 2002/0013687 | A1 | 1/2002 | Ortoleva | |
| 2002/0120429 | A1 | 8/2002 | Ortoleva | |
| 2005/0149307 | A1 | 7/2005 | Gurpinar et al. | |
| 2005/0209912 | A1 | 9/2005 | Veeningen et al. | |
| 2006/0289157 | A1 * | 12/2006 | Rao | 166/268 |
| 2007/0284107 | A1 * | 12/2007 | Crichlow | 166/302 |
| 2008/0091283 | A1 | 4/2008 | Balci et al. | |
| 2008/0262898 | A1 | 10/2008 | Tonchev et al. | |
| 2009/0133871 | A1 | 5/2009 | Skinner et al. | |
| 2010/0057418 | A1 | 3/2010 | Li et al. | |
| 2010/0082142 | A1 | 4/2010 | Usadi et al. | |

OTHER PUBLICATIONS

Saleri et al., "Engineering Control in Reservoir Simulation: Parts I and II", SPE 18305, 1988.
Saleri et al., "Data and Data Hierarchy", SPE 21369, pp. 1286-1293, Dec. 1992.
Saleri, "Reservoir Performance Forecasting: Acceleration by Parallel Planning", JPT, pp. 652-657, Jul. 1993.
Saleri, "'Learning' Reservoirs: Adapting to Disruptive Technologies", JPT, pp. 57-60, Mar. 2002.
Saleri et al., "The Expanding Role of the Drill Bit in Shaping the Subsurface", JPT, pp. 53-58, Dec. 2003.
Saleri et al., "Shaybah-220: A Maximum-Reservoir-Contact (MRC) Well and Its Implications for Developing Tight-Facies Reservoirs", SPE Reservoir Evaluation & Engineering, pp. 316-320, Aug. 2004.
Saleri, "Reservoir Management Tenets: Why They Matter to Sustainable Supplies", JPT, pp. 28-30, Jan. 2005.
Saleri, "Tenets and Diagnostics in Modern Reservoir Management", 8th International Forum on Reservoir Simulation, Jun. 2005, Stressa, Italy.
Saleri, "The Next Trillion: Anticipating and Enabling Game-Changing Recoveries", JPT, Apr. 2006.

(Continued)

*Primary Examiner* — Bryan Bui
(74) *Attorney, Agent, or Firm* — Workman Nydegger

(57) ABSTRACT

Determining a Recovery Deficiency Indicator™ (RDI™) for a petroleum reservoir provides a novel leading indicator and metric that is designed to quickly assess the potential for increases in reserves and ultimate recovery of petroleum from an operating petroleum reservoir. The RDI™ is determined by relating the Recovery Efficiency (RE) and the Ideal Recovery Efficiency (IRE) (e.g., by dividing RE by IRE to obtain RDI™). The Recovery Efficiency (RE) is determined as the product of areal displacement efficiency ($E_A$), vertical displacement efficiency ($E_V$), and pore displacement efficiency ($E_D$). The Ideal Recovery Efficiency (RE) can be determined by empirically assuming that $E_A$ and $E_V$ equal 100%.

22 Claims, 6 Drawing Sheets

OTHER PUBLICATIONS

Saleri, "Haradh III: A Milestone for Smart Fields", JPT, Nov. 2006.

Saleri, "Dawn in the Desert: Saudi High Tech Paying Off at Ghawar", Energy Tribune, pp. 15-17, Sep. 2007.

Helman, "The Octopus", Forbes Energy & Genius, pp. 44-51, Nov. 24, 2008.

U.S. Appl. No. 12/392,891, filed Feb. 25, 2009, Office Action dated Dec. 8, 2010.

U.S. Appl. No. 12/392,891, filed Feb. 25, 2009, Notice of allowanced and issue fee dated Mar. 24, 2011.

U.S. Appl. No. 12/915,278, filed Oct. 19, 2010, Office Action dated Nov. 7, 2011.

U.S. Appl. No. 12/606,027, filed Oct. 26, 2009, Final Office Action dated Jan. 19, 2012.

U.S. Appl. No. 12/567,404, filed Oct. 25, 2009, Notice of Allowance dated Feb. 7, 2012.

* cited by examiner

ASSESSING PETROLEUM RESERVOIR RESERVES AND POTENTIAL FOR INCREASING ULTIMATE RECOVERY

CROSS REFERENCE TO RELATED APPLICATIONS

This application claims the benefit of U.S. Provisional Application No. 61/101,008, filed Sep. 29, 2008, and entitled "ASSESSING PETROLEUM RESERVOIR RESERVES AND POTENTIAL FOR INCREASE", the disclosure of which is incorporated herein in its entirety.

BACKGROUND OF THE INVENTION

1. The Field of the Invention

The invention is in the field of petroleum recovery, more particularly in the field of assessing recoverable petroleum reservoir reserves and potential for increasing the amount of recoverable petroleum from a reservoir.

2. The Relevant Technology

Petroleum is a critical fuel source and is the life blood of modern society. There is tremendous economic opportunity in finding and extracting petroleum. Due to a variety of technical and geological obstacles, it is typically impossible to recover all of the petroleum contained in a reservoir.

Until 1965, typical petroleum reservoir recovery rates were approximately 25%. That is, that was the fraction of petroleum within a reservoir that could be economically and/or feasibly extracted. The remaining 75% was essentially unrecoverable due to technological and/or economic impediments. Since then, with advancing technologies and increasing economic incentives due to higher crude oil prices, the average recovery rate has increased to about 35%. Further increases may be possible through improved recovery techniques and management and higher economic incentives. The challenge is to reliably assess the potential for reserves increases in order to accurately determine the present value and production capacity of a reservoir.

Given the high cost of exploration, dwindling opportunities to find new petroleum reservoirs, and the rising cost of petroleum as a commodity, there currently exists a tremendous economic opportunity for more accurately assessing petroleum reserves and the potential for reserves increases. Current methods for assessing petroleum reserves and potential reserves increases take years, and there is no method of standard validation for the results. Moreover, because production and reservoir depletion continue during the assessment process, the results may in fact comprise obsolete data and assumptions. There is currently no known method for accurately assessing petroleum reservoir reserves and the potential for increasing reserves in a short period of time (i.e., within days, weeks or months rather than years).

While the technology may, in fact, exist to increase total long-term recovery for a petroleum reservoir, an impediment to implementing an intelligent long-term plan for maximizing current output, extending the life of a given reservoir, and increasing total recovery is the inability to accurately assess the health and deficiencies of the reservoir. For example, some or all of the producing wells of a reservoir may show diminishing output, which might lead some to believe the reservoir is drying up. However, the reservoir may, in fact, contain much larger quantities of recoverable petroleum but be under-producing simply due to poor placement and/or management of the existing wells and the failure to know whether and where to place new wells. The inability to properly diagnose inefficiencies and failures and implement an intelligent recovery plan can result in diminished short-term productivity and long-term recovery of petroleum from a reservoir.

In general, those who operate production facilities typically focus on oil well maintenance and may even implement the latest technologies for maximizing well output. They fail, however, to understand the total picture of health and longevity of the reservoir, which may be serviced by several wells. Wells are difficult and expensive to drill and operate. Once a given number of wells are in place, it may be economically infeasible to drill more wells in order to increase reservoir production (i.e., the marginal cost may exceed the marginal benefit). Moreover, there may be no apparent reason to shut down a producing well even though doing so might actually increase long-term recovery. The knowledge of when and why to shut down or alter a producing well and/or properly construct a new well often eludes even the most experienced producers and well managers. The failure to properly manage existing wells and/or place and construct new wells can increase capital costs while reducing ultimate recovery.

The main impediment to maximizing production and recovery from a reservoir is the inability to gather, intelligently analyze, and correctly understand the relevant data. Diagnosing the health of a petroleum reservoir is not straightforward and is much like trying to decipher the health of a human body, but at a location far beneath the earth or ocean. Moreover, the available data may take years to accumulate and assess, yet may be dynamically changing, making it difficult, if not impossible, to formulate and implement an economically and/or technically feasible plan of action. The result is continuing low productivity and long-term recovery from the petroleum reservoir.

SUMMARY

Embodiments of the invention are directed toward determining, for a given petroleum reservoir, a reservoir Recovery Deficiency Indicator™ ("RDI™"), which is a measurement of the potential for increasing the amount of petroleum that can ultimately be recovered from the reservoir, which is therefore an indicator of the potential increase in reservoir reserves. The smaller the RDI™ and the further a reservoir is from the ideal recovery for that reservoir, the greater is the potential for increasing ultimate recovery and reserves.

In general terms, embodiments of the invention involve determining, for a given reservoir, an Ideal Recovery Efficiency ("IRE") value and then comparing the actual Recovery Efficiency ("RE") with the Ideal Recovery Efficiency in order to obtain the Recovery Deficiency Indicator (RDI). According to one embodiment, the Recovery Deficiency Indicator™ (RDI™) is determined by taking the ratio of actual Recovery Efficiency (RE) to the Ideal Recovery Efficiency (IRE), as represented by the following equation:

$$\text{RDI™}=\text{RE}/\text{IRE}$$

According to one embodiment, the Recovery Efficiency (RE) can be determined using the following equation:

$$\text{RE}=E_A*R_I*E_D$$

where, $E_A$=areal displacement efficiency of the petroleum reservoir, which is the fraction of floodable pore volume area swept by a displacing fluid;

$E_I$=vertical displacement efficiency of the petroleum reservoir, which is the fraction of the floodable pore volume in the vertical plane swept by a displacing fluid; and $E_D$=pore displacement efficiency of the petroleum reservoir, which is the fraction of oil saturation at the start of injection which is displaced by a displacing fluid in the invaded zone.

The areal displacement efficiency and vertical displacement efficiency can be determined by taking appropriate measurements of the amount of oil that is actually removed across the area and in the vertical direction of a petroleum reservoir. According to one embodiment, this may be accomplished by collecting data using observation wells and/or using newly drilled and logged wells in various locations throughout the reservoir. In some cases the areal and/or vertical displacement efficiencies and/or the data required for determining the areal and/or vertical displacement efficiencies may be provided by the reservoir manager. In other cases, existing information may be supplemented by further data collection in order to carry out the inventive methods. The different data points may be statistically weighted according to identified differences in the areal and vertical displacement efficiencies in different geographic regions throughout the petroleum reservoir and/or the extraction technique being utilized to recover petroleum from the reservoir in order to accurately estimate the overall areal and vertical displacement efficiencies of the reservoir.

The pore displacement efficiency can be determined by taking core samples from various locations throughout the petroleum reservoir and determining the initial oil saturation of the core samples, the initial water saturation of the core samples, and measuring the residual oil saturation of the core samples after being flooded by a displacing fluid (e.g., ten pore volumes of the displacing fluid). According to one embodiment, the pore displacement efficiency can be determined according to the following equation:

$$E_D=1-(S_{OR}/(1-S_{WC}))$$

wherein, $S_{OR}$ is defined as residual oil saturation, which can be measured on core plug samples in the lab after being flooded by a displacing fluid (e.g., ten pore volumes); and $S_{WC}$ is the water saturation at initial reservoir conditions.

In some cases, the pore displacement efficiency and/or the data required for determining the pore displacement efficiency may be provided by the reservoir manager. In other cases, existing information may be supplemented by further data collection in order to carry out the inventive methods. In addition to or instead displacing oil in the core samples using a displacing fluid, the core samples can be tested using nuclear magnetic resonance (NMR) and/or a tomography CT-scan to better understand how and how much of the cores are being drained. The different data points may be statistically weighted according to identified differences in the pore displacement efficiency in different geographic regions throughout the petroleum reservoir and/or the extraction technique being utilized to recover petroleum from the reservoir in order to accurately estimate the overall pore displacement efficiency of the reservoir.

The Ideal Recovery Efficiency (IRE) is obtained by setting the areal displacement efficiency ($E_A$) and vertical displacement efficiency ($E_V$) to 100%, which assumes an ideal volumetric sweep of the oil. That is based on the assumption, borne out by experience with very long-lived oil reservoirs in the Middle East and East Texas, that $E_A$ and $E_V$ values, and therefore the sweep efficiency, can reach 100%, especially using modern extraction technology (e.g., drilling, completion, formation evaluation, reservoir stimulation, and the like). The Ideal Recovery Efficiency can then be denoted by the equation: IRE=$E_D$.

According to one embodiment, one or more of the Recovery Deficiency Indicator™ (RDI™), Recovery Efficiency (RE), and Ideal Recovery Efficiency (IRE) can be determined using a computer system having a processor and system memory. Data relating to the sweep efficiency and pore displacement efficiency, which are themselves physical measurements of petroleum reservoir attributes obtained using physical apparatus or machinery, can be input into a computer system, which then calculates, using a processor and system memory, one or more of the Recovery Deficiency Indicator™ (RDI™), Recovery Efficiency (RE), and Ideal Recovery Efficiency (IRE). The computer system transforms initial data relating to the characteristics of the petroleum reservoir into final data that ultimately identifies the Recovery Deficiency Indicator™ (RDI™) for the petroleum reservoir.

Recovery Deficiency Indicator™ (RDI™) scores can be ranked depending on the opportunity for improving reserve values. An RDI™ score between 90-100% generally indicate a well assessed and operated reservoir with only a small opportunity for improvement in petroleum reserves. An RDI™ score between 80-90% generally indicates that reserves can be marginally improved. An RDI™ score between 60-80% indicates that reserves can be significantly improved. An RDI™ score between 40-60% means that reserves can be substantially improved. An RDI™ score below 40% indicates that a reservoir recovery assumptions, practices, and techniques require total revision.

In general, the Recovery Deficiency Indicator™ (RDI™) is a new leading indicator or metric designed to quickly assess the potential for increasing ultimate recover and reserves in a producing petroleum reservoir. Embodiments of the invention provide management, engineers and investors with an effective tool to identify opportunities to improve recovery efficiency with well-recognized financial benefits to involved parties. In general, use of Recovery Deficiency Indicator™ (RDI™) can highlight problems in the sweep efficiency and the extraction techniques used to drain the reservoir, whether areal, vertical or both.

This new evaluation tool is intended to provide decision makers with an objective, simplified and rapid methodology to evaluate and grade the current recovery efficiency of a particular reservoir by relating it to the ideal recovery efficiency for the reservoir. The concept of determining an ideal recovery efficiency and using it to evaluate and grade current recovery efficiency is an entirely new concept developed by the inventors. Notwithstanding its simplicity, and indeed as a result of its simplified methodology compared to conventional practices, the present invention provides a revolutionary new tool that can effectively assess the potential for petroleum reserves increase which, in turn, permits interested parties to devise more effective and intelligent strategies for closing the gap between actual and ideal recovery efficiencies.

The Recovery Deficiency Indicator™ (RDI™) can advantageously be used as part of a more comprehensive reservoir evaluation system and methodology known as Reservoir Competency Asymmetric Assessment™ (or RCAA™), which is discussed more fully below in the Detailed Description.

These and other advantages and features of the present disclosure will become more fully apparent from the following description and appended claims, or may be learned by the practice of embodiments of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF PREFERRED EMBODIMENTS

I. Introduction and Background

Figure 1:
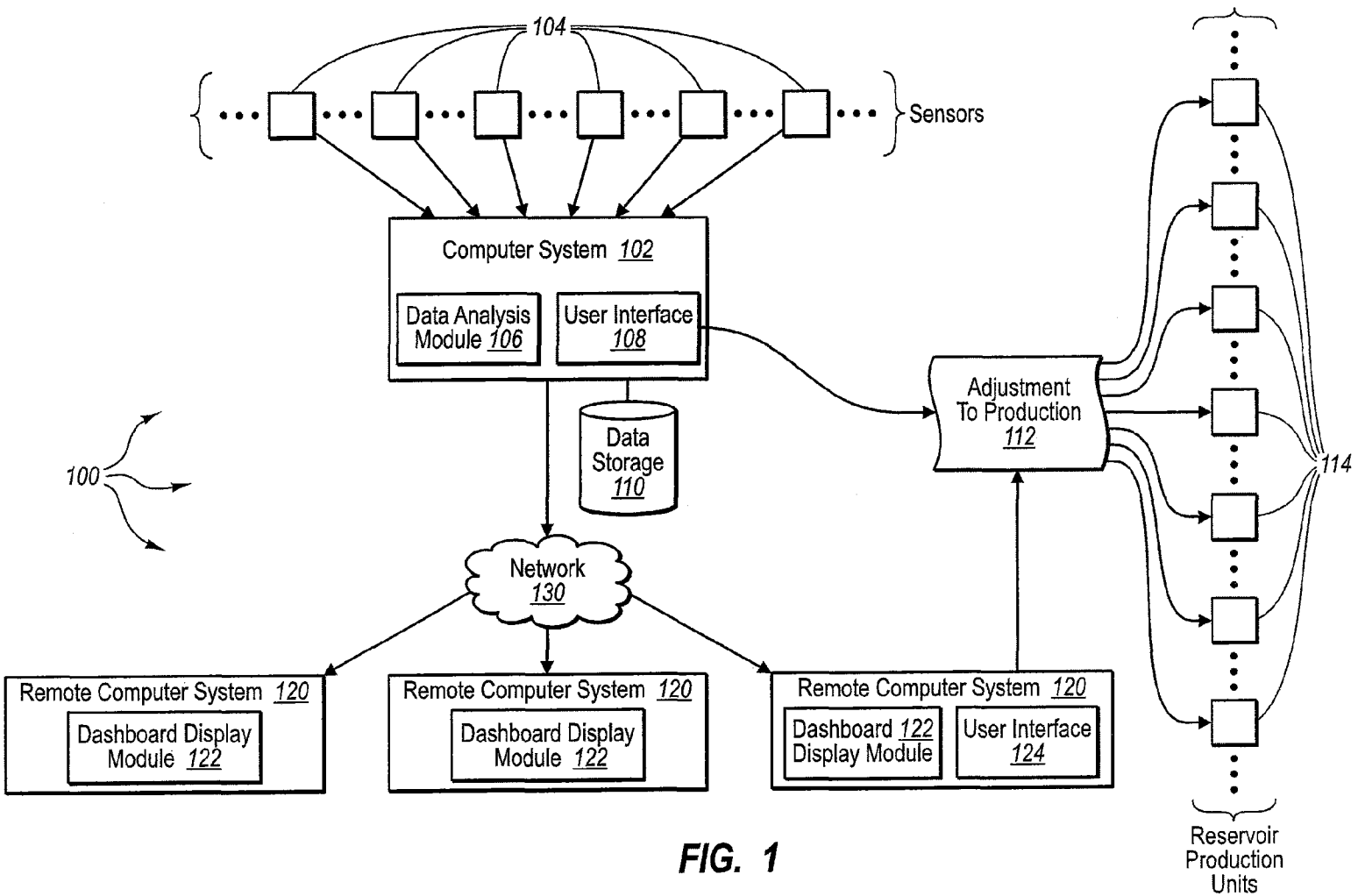
FIG. 1 schematically illustrates exemplary computer-implemented or controlled architecture that can be used to gather, analyze and/or display data gathered from and about a petroleum reservoir.

Preferred embodiments of the invention relate to the determination of a Recovery Deficiency Indictor™ (RDI™) for a petroleum reservoir, which is a novel leading indicator and metric that is designed to quickly assess the potential for increases in reserves of an operating petroleum reservoir. Embodiments of the invention provide management, engineers and investors with an effective tool to identify opportunities to improve recovery efficiency with well-recognized financial benefits to involved parties.

The Recovery Deficiency Indictor™ (RDI™) is particularly useful when used in conjunction with, and as an important component of, a larger, more comprehensive system for assessing petroleum reservoir competency and developed by the inventors and known as Reservoir Competency Asymmetric Assessment™ (or RCAA™). A comprehensive description of RCAA™ is set forth in U.S. patent application Ser. No. 12/392,891, filed Feb. 25, 2009 and entitled "METHOD FOR DYNAMICALLY ASSESSING PETROLEUM RESERVOIR COMPETENCY AND INCREASING PRODUCTION AND RECOVERY THROUGH ASYMMETRIC ANALYSIS OF PERFORMANCE METRICS". The foregoing application is incorporated herein in its entirety.

By way of background, RCAA™ includes several closely interrelated sub-methods or modules that are employed in concert and sequentially. They are (i) analyzing and diagnosing the specific and unique features of a reservoir (i.e., its "DNA") using targeted metrics, of which the Recovery Deficiency Indictor™ (RDI™) is one of the components, (ii) designing a recovery plan for maximizing or increasing current production and ultimate recovery (e.g., increasing recoverable petroleum reserves) from the petroleum reservoir, (iii) implementing the recovery plan so as to increase current production and ultimate recovery of petroleum from the reservoir, and (iv) monitoring or tracking the performance of the petroleum reservoir using targeted metrics and making adjustments to production parameters, as necessary, to maintain desired productivity and recovery.

RCAA™ relies on intense knowledge gathering techniques, which include taking direct measurements of the physics, geology, and other unique conditions and aspects of the reservoir and, where applicable, considering the type, number, location and efficacy of any wells that are servicing, or otherwise associated with, the reservoir (e.g., producing wells, dead wells, and observation wells), analyzing the present condition or state of the reservoir using asymmetric weighting of different metrics, and prognosticating future production, recovery and other variables based on a comprehensive understanding of the specific reservoir DNA coupled with the asymmetric weighting and analysis of the data. In some cases, the gathered information may relate to measurements and data generated by others (e.g., the reservoir manager).

In general, RCAA™ is an assessment process which guides both the planning and implementation phases of petroleum recovery. All hydrocarbon assets carry an individual "DNA" reflective of their subsurface and surface features. RCAA™ is an enabling tool for developing and applying extraction methods which are optimally designed to the specifications of individual hydrocarbon reservoirs. Its main value is assisting in the realization of incremental barrels of reserves and production over and above levels being achieved using standard industry techniques. This, in turn, may reduce long-term capital and operating expenses.

According to one embodiment, implementation of RCAA™ spans six interweaving and interdependent tracks: i) Knowledge Systems; ii) Q6 Surveys; iii) Deep Insight Workshops; iv) Q-Diagnostics; v) Gap Analysis; and vi) Plan of Action. The information gathered from these tracks is integrated using modern knowledge-sharing mediums including web-based systems and communities of practice. While the overall business model of RCAA™ includes both technological and non-technological means for gathering the relevant information, the method cannot be implemented without the use of physical processes and machinery for gathering key information. Moreover, implementing a plan of action involves computerized monitoring of well activity. And enhanced reservoir performance results in a physical transformation of the reservoir itself.

Determining the Recovery Deficiency Indictor™ (RDI™) similarly involves physical processes and machinery for gathering key information. Converting such information, which relates to both the geological characteristics of the reservoir as well as operational attributes of the petroleum recovery plan, into a Recovery Deficiency Indictor™ (RDI™) is a transformation of essentially physical data into a diagnostic determination or score of the petroleum reservoir. To the extent that such transformations of data are carried out using a computer system programmed to generate the Recovery Deficiency Indictor™ (RDI™) from the underlying data, more particularly using a processor and system memory, such a computer system is itself a machine.

Because the subsurface plumbing of the reservoir is not homogeneous, it will often be necessary to statistically weight some data points more than others in order to come up with a more accurate assessment of the reservoir. In some cases, outlier data points may simply be anomalies and can be ignored or minimized. In other cases, outliers that show increased recovery efficiency for one or more specific regions of the reservoir which may themselves be the ideal and indicate that extraction techniques used in other, less productive regions of the reservoir need improvement.

Physical processes that utilize machinery to gather data include, for example, 1) coring to obtain down hole rock samples (both conventional and special coring), 2) taking down hole fluid samples of oil, water and gas, 3) measuring initial pressures from radio frequency telemetry or like devices, and 4) determining fluid saturations from well logs (both cased hole and open hole). Moreover, once a plan of action is implemented and production and/or recovery from the reservoir are increased, the reservoir is transformed from a lower-producing to a higher-producing asset.

Monitoring the performance of the reservoir before, during and/or after implementation of a plan of action involves the use of a computerized system (i.e., part of a "control room") that receives, analyzes and displays relevant data (e.g., to and/or between one or more computers networked together and/or interconnected by the internet). Examples of metrics that can be monitored include 1) reservoir pressure and fluid saturations and changes with logging devices, 2) well productivity and drawdown with logging devices, fluid profile in production and injection wells with logging devices, and oil, gas and water production and injection rates. Relevant metrics can be transmitted and displayed to recipients using the internet or other network. Web based systems can share such data.

FIG. 1 illustrates an exemplary computer-implement monitoring system 100 that monitors reservoir performance, analyzes information regarding reservoir performance, displays dashboard metrics, and optionally provides for computer-controlled modifications to maintain optimal oil well performance. Monitoring system 100 includes a main data gathering computer system 102 comprised of one or more computers located near a reservoir and linked to reservoir sensors 104. Each computer typically includes at least one processor and system memory. Computer system 102 may comprise a plurality of networked computers (e.g., each of which is designed to analyze a sub-set of the overall data generated by and received from the sensors 101 404). Reservoir sensors 104 are typically positioned at producing oil well, and may include both surface and sub-surface sensors. Sensors 104 may also be positioned at water injection wells, observation wells, etc. The data gathered by the sensors 104 can be used to generate performance metrics (e.g., leading and lagging indicators of production and recovery), including those which relate to the determination of the Recovery Deficiency Indicator™ (RDI™). The computer system 102 may therefore include a data analysis module 106 programmed to generate metrics from the received sensor data. A user interface 108 provides interactivity with a user, including the ability to input data relating to areal displacement efficiency, vertical displacement efficiency, and pore displacement efficiency. Data storage device or system 110 can be used for long term storage of data and metrics generated from the data, including data and metrics relating to the Recovery Deficiency Indicator™ (RDI™)

According to one embodiment, the computer system 102 can provide for at least one of manual or automatic adjustment to production 112 by reservoir production units 114 (e.g., producing oil wells, water injection wells, gas injection wells, heat injectors, and the like, and sub-components thereof). Adjustments might include, for example changes in volume, pressure, temperature, well bore path (e.g., via closing or opening of well bore branches). The user interface 108 permits manual adjustments to production 112. The computer system 102 may, in addition, include alarm levels or triggers that, when certain conditions are met, provide for automatic adjustments to production 112.

Monitoring system 100 may also include one or more remote computers 120 that permit a user, team of users, or multiple parties to access information generated by main computer system 102. For example, each remote computer 120 may include a dashboard display module 122 that renders and displays dashboards, metrics, or other information relating to reservoir production. Each remote computer 120 may also include a user interface 124 that permits a user to make adjustment to production 112 by reservoir production units 114. Each remote computer 120 may also include a data storage device (not shown).

Individual computer systems within monitoring system 100 (e.g., main computer system 102 and remote computers 120) can be connected to a network 130, such as, for example, a local area network ("LAN"), a wide area network ("WAN"), or even the Internet. The various components can receive and send data to each other, as well as other components connected to the network. Networked computer systems and computers themselves constitute a "computer system" for purposes of this disclosure.

Networks facilitating communication between computer systems and other electronic devices can utilize any of a wide range of (potentially interoperating) protocols including, but not limited to, the IEEE 802 suite of wireless protocols, Radio Frequency Identification ("RFID") protocols, ultrasound protocols, infrared protocols, cellular protocols, one-way and two-way wireless paging protocols, Global Positioning System ("GPS") protocols, wired and wireless broadband protocols, ultra-wideband "mesh" protocols, etc. Accordingly, computer systems and other devices can create message related data and exchange message related data (e.g., Internet Protocol ("IP") datagrams and other higher layer protocols that utilize IP datagrams, such as, Transmission Control Protocol ("TCP"), Remote Desktop Protocol ("RDP"), Hypertext Transfer Protocol ("HTTP"), Simple Mail Transfer Protocol ("SMTP"), Simple Object Access Protocol ("SOAP"), etc.) over the network.

Computer systems and electronic devices may be configured to utilize protocols that are appropriate based on corresponding computer system and electronic device on functionality. Components within the architecture can be configured to convert between various protocols to facilitate compatible communication. Computer systems and electronic devices may be configured with multiple protocols and use different protocols to implement different functionality. For example, a sensor 104 at an oil well might transmit data via wire connection, infrared or other wireless protocol to a receiver (not shown) interfaced with a computer, which can then forward the data via fast ethernet to main computer system 102 for processing. Similarly, the reservoir production units 114 can be connected to main computer system 102 and/or remote computers 120 by wire connection or wireless protocol.

II. Determining the Recovery Deficiency Indicator™ of a Petroleum Reservoir

Figure 2:
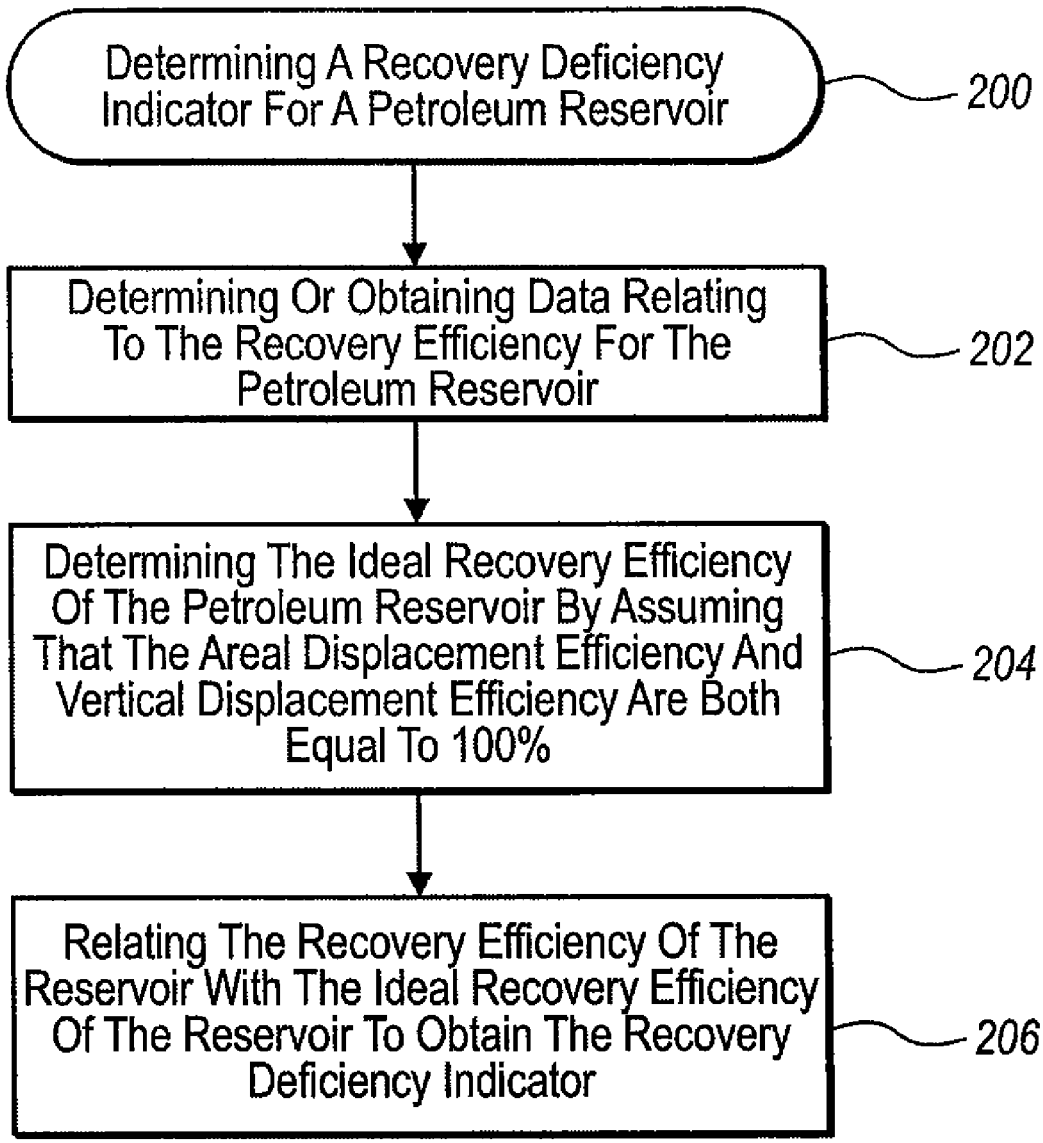
FIG. 2 is a flow diagram that illustrates exemplary acts for determining a Recovery Deficiency Indicator™ (RDI™) for a petroleum reservoir.

FIG. 2 is a block diagram that illustrates the general acts or steps involved in a process 200 for determining the Recovery Deficiency Indicator™ (RDI™) of a petroleum reservoir. Process or sequence 200 includes an act or step 202 of determining or obtaining data relating to the Recovery Efficiency (RE) of the petroleum reservoir. As will be explained more fully below, determining the Recovery Efficiency (RE) includes relating together the areal displacement efficiency, the vertical displacement efficiency, and the pore displacement efficiency. The process or sequence 200 further includes an act or step 204 of determining the Ideal Recovery Efficiency (IRE) of the petroleum reservoir. The Ideal Recovery Efficiency (IRE) is determined by assuming that the areal and vertical displacement efficiencies are both 100%. The process or sequence 200 further includes an act or step 206 of relating the Recovery Efficiency (RE) of the petroleum reservoir with the Ideal Recovery Efficiency (IRE) of the petroleum, reservoir to obtain the Recovery Deficiency Indicator™ (RDI™) such as, for example, according to the following equation:

$$RDI=RE/IRE$$

Because the Ideal Recovery Efficiency (IRE) is based on the assumption that the areal and vertical displacement efficiencies are both 100%, the Ideal Recovery Efficiency (IRE) is essentially equivalent to the pore displacement efficiency according to the following equation:

$$IRE=E_D$$

wherein, $E_D$=pore displacement efficiency of the petroleum reservoir, which is the fraction of oil saturation at the start of injection which is displaced by a displacing fluid in the invaded zone.

Figure 3:
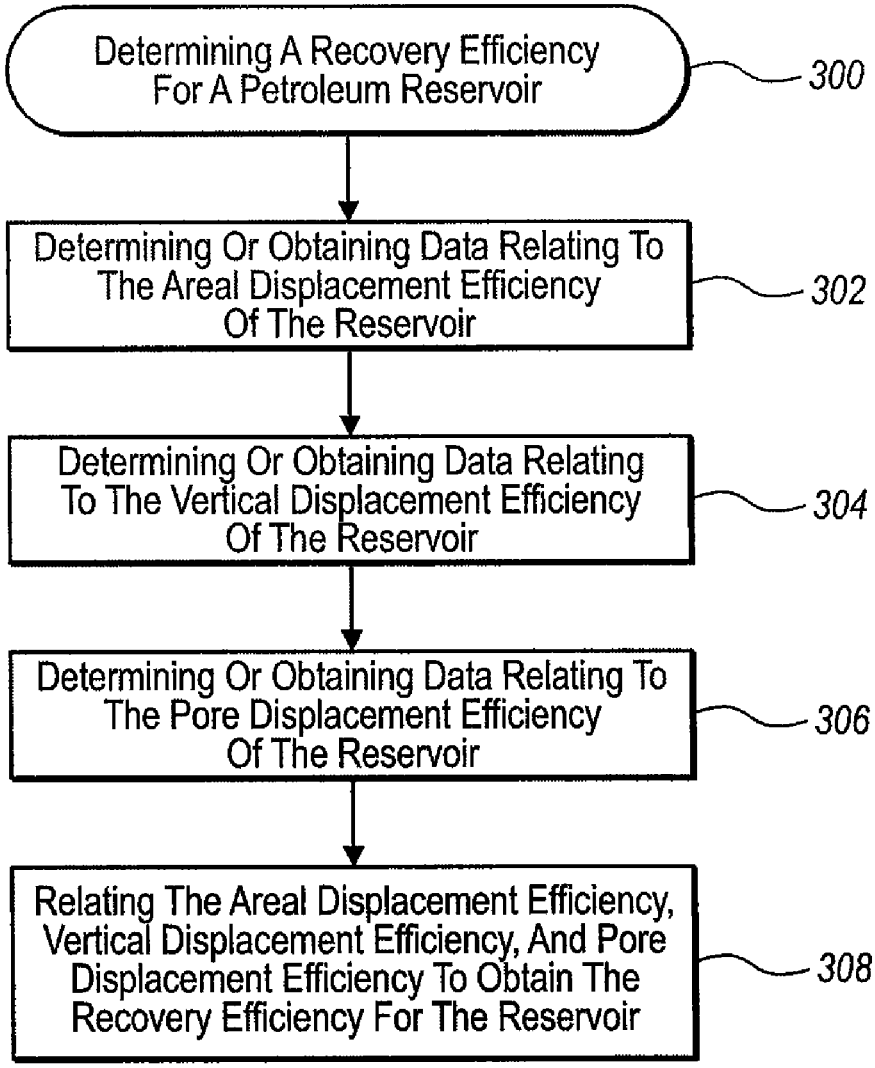
FIG. 3 is a flow diagram that illustrates exemplary acts for determining the Recovery Efficiency for a petroleum reservoir.

FIG. 3 is a block diagram that illustrates the general acts or steps involved in a process 300 for determining the Recovery Efficiency (RE) of a petroleum reservoir. Process or sequence 300 includes an act or step 302 of determining or obtaining data relating to the areal displacement efficiency of the petroleum reservoir. Process or sequence 300 further includes an act or step 304 of determining or obtaining data relating to the vertical displacement efficiency of the petroleum reservoir. Process or sequence 300 further includes an act or step 306 of determining or obtaining data relating to the pore displacement efficiency of the petroleum reservoir. Finally, process or sequence 300 includes an act or step 308 of relating the areal displacement efficiency, vertical displacement efficiency, and pore displacement efficiency to obtain the Recovery Deficiency™ (RDI™) such as, for example, according to the following equation:

$$RE=E_A*E_I*E_D$$

wherein, $E_A$=areal displacement efficiency of the petroleum reservoir, which is the fraction of floodable pore volume area swept by a displacing fluid;

$E_I$=vertical displacement efficiency of the petroleum reservoir, which is the fraction of the floodable pore volume in the vertical plane swept by a displacing fluid; and $E_D$=pore displacement efficiency of the petroleum reservoir, which is the fraction of oil saturation at the start of injection which is displaced by a displacing fluid in the invaded zone.

Figure 4:
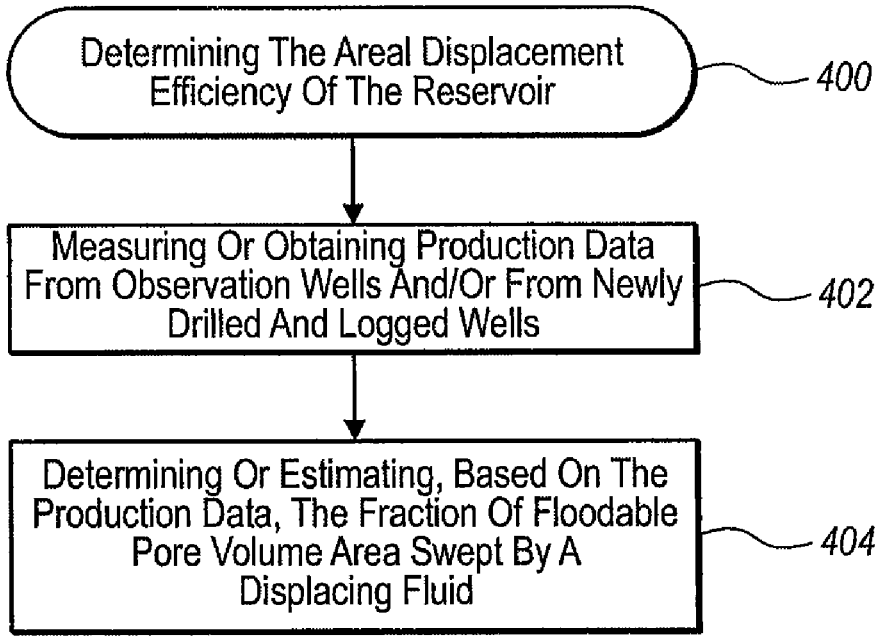
FIG. 4 is a flow diagram that illustrates exemplary acts for determining the Areal Displacement Efficiency for a petroleum reservoir.
Figure 5:
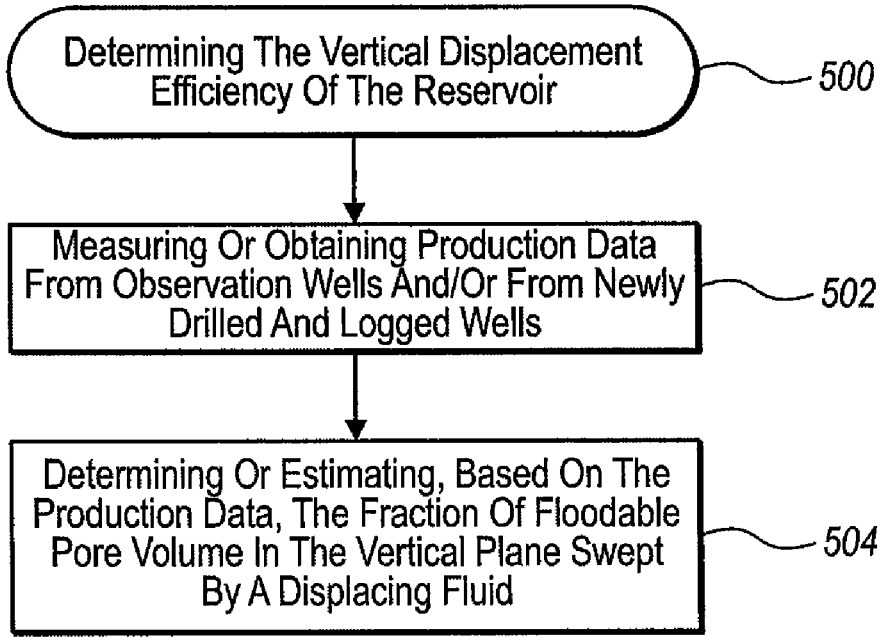
FIG. 5 is a flow diagram that illustrates exemplary acts for determining the Vertical Displacement Efficiency for a petroleum reservoir.
Figure 6:
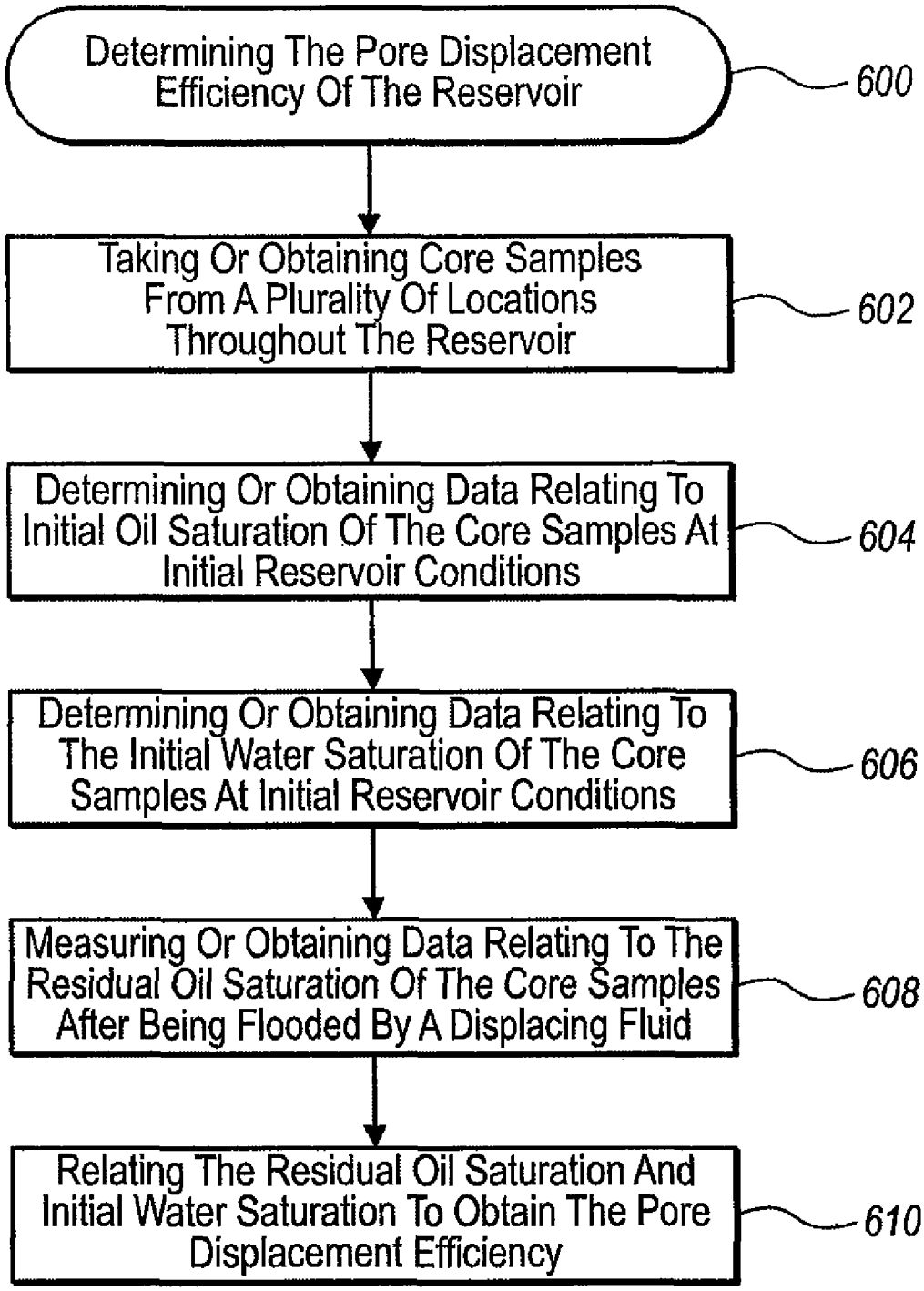
FIG. 6 is a flow diagram that illustrates exemplary acts for determining the Pore Displacement Efficiency for a petroleum reservoir.

FIGS. 4-6 are block diagrams that illustrate exemplary acts or steps used in a process 400 for determining the areal displacement efficiency, a process 500 for determining the vertical displacement efficiency, and a process 600 for determining pore displacement efficiency of the petroleum reservoir. Exemplary process or sequence 400 for determining areal displacement efficiency of a petroleum reservoir includes an act or step 402 of measuring or obtaining production data from observation wells and/or from newly drilled and logged wells at various locations throughout the petroleum reservoir. Process or sequence 400 further includes an act or step 404 of determining or estimating, based on the production data, the fraction of floodable pore volume area that is swept by a displacing fluid.

Exemplary process or sequence 500 for determining vertical displacement efficiency of a petroleum reservoir includes an act or step 502 of measuring or obtaining production data from observation wells and/or from newly drilled and logged wells at various locations throughout the petroleum reservoir. Process or sequence 500 further includes an act or step 504 of determining or estimating, based on the production data, the fraction of floodable pore volume in the vertical plane that is swept by a displacing fluid.

According to one embodiment, the areal displacement efficiency and vertical displacement efficiency can be determined by taking appropriate measurements of the amount of oil that is actually removed across the area and in the vertical direction of a petroleum reservoir. According to one embodiment, this is accomplished by collecting data using observation wells and/or using newly drilled and logged wells in various locations throughout the reservoir. In some cases the areal and/or vertical displacement efficiencies and/or the data required for determining the areal and/or vertical displacement efficiencies may be provided by the reservoir manager. In other cases, existing information may be supplemented by further data collection in order to carry out the inventive methods. The different data points may be statistically weighted according to identified differences in the areal and vertical displacement efficiencies in different geographic regions throughout the petroleum reservoir and/or the extraction technique being utilized to recover petroleum from the reservoir in order to accurately estimate the overall areal and vertical displacement efficiencies of the reservoir.

According to one embodiment, the pore displacement efficiency ($E_D$) can be determined according the following equation:

$$E_D=1-(S_{OR}/(1-S_{WC}))$$

wherein, $S_{OR}$ is defined as residual oil saturation, which can be measured on core plug samples in the lab after being flooded by ten pore volumes of a displacing fluid; and $S_{WC}$ is the water saturation at initial reservoir conditions.

In view of the foregoing, one exemplary process or sequence 600 for determining the pore displacement efficiency of a petroleum reservoir includes (1) an act or step 602 of taking or obtaining core samples from various locations throughout the petroleum reservoir; (2) an act or step of determining or obtaining data relating to the initial oil saturation of the core samples at initial reservoir conditions; (3) determining or obtaining data relating to the initial water saturation of the core samples at initial reservoir conditions; (4) measuring or obtaining data relating to the residual oil saturation of the core samples after being flooded by a displacing fluid (e.g., using ten pore volumes of the displacing fluid); and (5) relating the residual oil saturation and initial water saturation to obtain the pore displacement efficiency according to the foregoing equation.

According to one embodiment, the pore displacement efficiency is determined by collecting core samples from various locations throughout the reservoir. In some cases the pore displacement efficiency and/or the data required for determining the pore displacement efficiency may be provided by the reservoir manager. In other cases, existing information may be supplemented by further data collection in order to carry out the inventive methods. In addition to or instead displacing oil in the core samples using a displacing fluid, the core samples can be tested using nuclear magnetic resonance (NMR) and/or a tomography CT-scan.

The different data points may be statistically weighted according to identified differences in the pore displacement efficiency in different geographic regions throughout the petroleum reservoir and/or the extraction technique being utilized to recover petroleum from the reservoir in order to accurately estimate the overall pore displacement efficiency of the reservoir. In some cases, oil contained in different types of rock within the same core sample may drain differently, which provides information that may lead to improved techniques for increasing short-term production and long-term recovery of petroleum from the reservoir. Careful analysis of different pore drainage characteristics among different core samples, and even within different regions of individual core samples, can provide insights that help locate whether there are problems in areal sweep, vertical sweep, or both.

In summary, determination of the Recovery Deficiency Indicator™ (RDI™) can be performed by taking the ratio of the actual Recovery Efficiency (RE) and the Ideal Recovery Efficiency. The Ideal Recovery Efficiency (IRE) is based on the traditional petroleum engineering concept of Recovery Efficiency (RE), which can be defined as the ratio of the volume of produced oil to the volume of oil-initially-in-place ("OIIP"). Production experience in very long-lived oil reservoirs in the Middle East and East Texas indicate that values of areal displacement efficiency and vertical displacement efficiency can reach 100%, especially using modern extraction technologies (e.g., drilling, completion, formation evaluation, reservoir simulation, etc.). By assuming an ideal volumetric sweep, the IRE equation is simplified to just a determination of pore displacement efficiency. In other words, the Ideal Recovery Efficiency for a given petroleum reservoir is denoted by the equation: $IRE=E_D$.

Estimates of $E_A$ and $E_I$ can be made in the field from observation wells or by drilling and logging new wells in swept areas of the reservoir and are normally done within the context of an existing reservoir monitoring and surveillance plan. Estimates of $E_D$ can be made by analyzing core samples from different areas of the reservoir. Statistical analysis can weight different data points differently depending on differences in the characteristics of the petroleum reservoir (e.g., subsurface plumbing) and/or extraction techniques at different locations.

Reservoir Deficiency Indicator (RDI™) values can be broken into five ranges or Reservoir Deficiency Scores ("RDS"), which can be used to evaluate and highlight degrees of non-conformance and potential actions that can be taken to correct the shortfall in actual recovery efficiency compared to ideal recovery efficiency. According to one embodiment, the Reservoir Deficiency Scores can be tabulated as shown in Table 1 below:

TABLE 1

| RDI range (%) | RDS | Action |
|---|---|---|
| 100-90 | A | Small opportunity for improvement |
| 90-80 | B | Can be marginally improved |
| 80-60 | C | Can be improved |
| 60-40 | D | Can be significantly improved |
| <40 | F | Requires total revision |

According to one embodiment, an exemplary method for determining the Recovery Deficiency Indicator™ (RDI™) and corresponding reservoir deficiency score (RDS) for a producing field or reservoir comprises: (1) determining or obtaining the areal displacement efficiency ($E_A$) of the petroleum reservoir; (2) determining or obtaining the vertical displacement efficiency ($E_I$) of the petroleum reservoir; (3) determining or obtaining the pore displacement efficiency ($E_D$) of the petroleum reservoir; (4) determining the recovery efficiency (RE) of the reservoir based on the areal displacement efficiency ($E_A$), vertical displacement efficiency ($E_I$), and pore displacement efficiency ($E_D$); (5) determining the Ideal Recovery Efficiency (IRE) of the reservoir by assuming that the areal displacement efficiency ($E_A$) and vertical displacement efficiency ($E_V$) are 100% and setting $IRE=E_D$; (6) determining the Recovery Deficiency Indicator (RDI™) of the reservoir by determining the ratio between the Recovery Efficiency (RE) and Ideal Recovery Efficiency (IRE); and (7) assigning a Reservoir Deficiency Score (RDS) based on the Recovery Deficiency Indicator™ (RDI™) All or part of the foregoing method may be implemented, at least in part, using a conventional computer system comprised of one or more central processing units (CPUs), volatile system memory, non-volatile memory or storage, and one or more input-output devices.

Recovery deficiency indicators that are very high may indicate a highly efficiently operated reservoir with well implemented recovery techniques and strategies. On the other hand, scores that are very low indicate more room for improvement, translating into higher potential reserves. Scores that exceed 100%, or which are unrealistically close to 100%, may be evidence of fraud or inaccuracies in gathering and assessing data on the part of the reservoir owner.

Once the Recovery Deficiency Indicator™ of a petroleum reservoir has been determined and a Reservoir Deficiency Score has been assigned to the reservoir, the owner of the reservoir is in a better position to evaluate the costs and benefits of a recovery plan to increase current production and ultimate recovery of petroleum from the reservoir. Establishing a desired production rate and ultimate recovery for the petroleum reservoir generally considers how much a producer wishes to invest in increasing production and recovery of petroleum from the reservoir.

Figure 7:
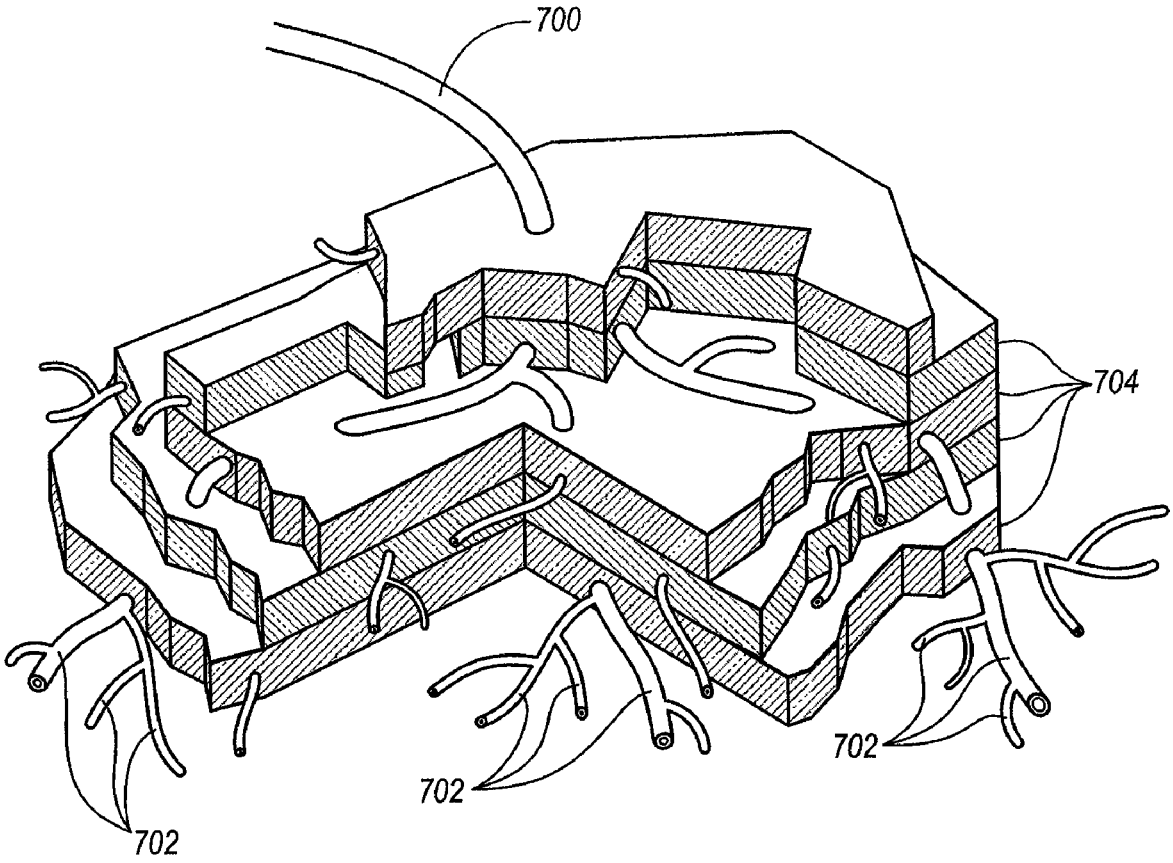
FIG. 7 illustrates an exemplary maximum reservoir contact (MRC) well used to increase productivity of a single producing oil well.

To maximize both daily production and long term productivity, a plan of action or production architecture may include the design and placement of at least one maximum contact well having a plurality of branched and at least partially horizontal well bores. This type of well is known as a "maximum reservoir contact" (MRC) well. An exemplary MRC well is schematically illustrated in FIG. 7, and includes a multiple branched well bore 700, including a plurality of spaced-apart well bore subsections 702 that extended generally horizontally through one or more strata 704 of the reservoir. The well bore subsections 702 may also be positioned vertically relative to each other in order to better drain oil found at different reservoir depths. In general, an MRC well can be used to better drain oil pockets that are generally fluidly interconnected.

In short, the present invention provides a simple, yet powerful, diagnostic tool that can be used to quickly and accurately assess the Recovery Deficiency Indicator™ for a producing petroleum reservoir or oil field. The inventiveness of the disclosed methods lies in their simplicity and ease of implementation. Although sophisticated managers and operators of petroleum reservoirs have been assessing productivity and managers reserves of petroleum reservoirs for decades, and there has existed a long-felt need for finding improved and more streamlined methods for assessing reservoir recovery and reserves, those of skill in the art have overlooked and failed to appreciate the powerful diagnostic power and quick implementation of the methods disclosed herein, which satisfy a long-felt need known in the art but heretofore unsatisfied. Moreover, the accuracy by which one may quickly determine a Recovery Deficiency Indicator™ for a reservoir, while foregoing years of complicated analysis, is unpredictable and an unexpected result.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. In a computing system having a processor and system memory and which is configured to receive and analyze data relating to the areal displacement efficiency ($E_A$), vertical displacement efficiency ($E_I$), and pore displacement efficiency ($E_D$) of a petroleum reservoir, a method for determining a recovery deficiency indicator (RDI) for a petroleum reservoir, comprising:

inputting into the computing system data relating to the areal displacement efficiency ($E_A$) of the petroleum reservoir;

inputting into the computing system data relating to the vertical displacement efficiency ($E_I$) of the petroleum reservoir;

inputting into the computing system data relating to the pore displacement efficiency ($E_D$) of the petroleum reservoir;

the computing system determining, by relating together the areal displacement efficiency ($E_A$), vertical displacement efficiency ($E_I$), and pore displacement efficiency ($E_D$), a recovery efficiency (RE) of the petroleum reservoir;

the computing system determining, based on at least the pore displacement efficiency ($E_D$), an ideal recovery efficiency (IRE) of the petroleum reservoir; and the computing system determining, by relating the recovery efficiency (RE) with the ideal recovery efficiency (IRE), the recovery deficiency indicator (RDI) for the petroleum reservoir.

2. The method as in claim 1, the data relating to the areal displacement efficiency ($E_A$) being obtained or derived from observation wells and/or by drilling and logging new wells in swept areas of the petroleum reservoir.

3. The method as in claim 2, the computing system statistically weighting different data points relating to the areal displacement efficiency at different locations throughout the petroleum reservoir to account for variations in areal displacement efficiencies across the reservoir.

4. The method as in claim 1, the data relating to the vertical displacement efficiency ($E_I$) being obtained or derived from observation wells and/or by drilling and logging new wells in swept areas of the petroleum reservoir.

5. The method as in claim 4, the computing system statistically weighting different data points relating to the vertical displacement efficiency at different locations throughout the petroleum reservoir to account for variations in vertical displacement efficiencies across the reservoir.

6. The method as in claim 1, the data relating to the pore displacement efficiency ($E_D$) being obtained or derived from core samples taken from a plurality of locations throughout the petroleum reservoir.

7. The method as in claim 6, the computing system determining pore displacement efficiency ($E_D$), at least in part, according to the following equation:

$$E_D=1-(S_{OR}/(1-S_{WC}))$$

wherein, $E_D$=the pore displacement efficiency of the petroleum reservoir;

$S_{OR}$=residual oil saturation of one or more core samples, which is measured on the one or more core samples after being flooded by a displacing fluid; and $S_{WC}$=water saturation of the one or more core samples at initial reservoir conditions.

8. The method as in claim 6, the computing system statistically weighting different data points relating to the pore displacement efficiency ($E_D$) at different locations throughout the petroleum reservoir to account for variations in pore displacement efficiencies across the reservoir.

9. The method as in claim 1, the computing system determining the recovery efficiency of the petroleum reservoir according to the following equation:

$$RE=E_A*E_I*E_D$$

wherein,

RE=the recovery efficiency of the petroleum reservoir;

$E_A$=areal displacement efficiency of the petroleum reservoir, which is the fraction of floodable pore volume area swept by a displacing fluid;

$E_I$=vertical displacement efficiency of the petroleum reservoir, which is the fraction of the floodable pore volume in the vertical plane swept by a displacing fluid; and $E_D$=pore displacement efficiency of the petroleum reservoir, which is the fraction of oil saturation at the start of injection which is displaced by a displacing fluid in the invaded zone.

10. The method as in claim 9, the computing system determining the ideal recovery efficiency of the petroleum reservoir according to the following equation:

$$IRE=E_D$$

wherein,

IRE=the ideal recovery efficiency of the petroleum reservoir;

$E_D$=pore displacement efficiency, which is the fraction of oil saturation at the start of injection which is displaced by a displacing fluid in the invaded zone.

11. The method as in claim 10, the computing system determining the recovery deficiency indicator of the petroleum reservoir according to the following equation:

$$RDI=RE/IRE$$

wherein,

RDI=the recovery deficiency indicator for the petroleum reservoir;

RE=the recovery efficiency of the petroleum reservoir;

IRE=the ideal recovery efficiency of the petroleum reservoir.

12. The method as in claim 1, the computing system further assigning a reservoir deficiency score for the petroleum reservoir based on the recovery deficiency indicator.

13. The method as in claim 12, the reservoir deficiency score indicating a determined amount of potential improvement in ultimate petroleum recovery from the petroleum reservoir.

14. The method as in claim 12, further comprising using the production gain index (PGI) as part of a method for implementing a recovery plan for increasing recoverable petroleum reserves of the petroleum reservoir.

15. A computer program product comprising one or more physical storage media having stored thereon executable instructions which, when implemented by a computing system, will cause the computing system to carry out the method of claim 1.

16. In a computing system having a processor and system memory and which is configured to receive and analyze data relating to the areal displacement efficiency, vertical displacement efficiency, and pore displacement efficiency of a petroleum reservoir, a method for determining a recovery deficiency indicator for a petroleum reservoir, comprising:

determining an areal displacement efficiency ($E_A$) of the petroleum reservoir from data obtained or derived from observation wells and/or by drilling and logging new wells in swept areas of the petroleum reservoir and inputting the areal displacement efficiency ($E_A$) into the computing system;

determining a vertical displacement efficiency ($E_I$) of the petroleum reservoir from data obtained or derived from observation wells and/or by drilling and logging new wells in swept areas of the petroleum reservoir and inputting the vertical displacement efficiency ($E_I$) into the computing system;

determining a pore displacement efficiency ($E_D$) of the petroleum reservoir from data obtained or derived from core samples taken from a plurality of locations throughout the petroleum reservoir and inputting the pore displacement efficiency ($E_D$) into the computing system;

the computing system determining a recovery efficiency (RE) of the petroleum reservoir according to the following equation: $RE=E_A*E_I*E_D$;

the computing system determining an ideal recovery efficiency (IRE) for the petroleum reservoir according to the following equation: $IRE=E_D$; and the computing system determining the recovery deficiency indicator (RDI) for the petroleum reservoir according to the following equation: RDI=RE/IRE.

17. A method for determining a recovery deficiency indicator (RDI) for a petroleum reservoir, comprising:

determining an areal displacement efficiency ($E_A$) of the petroleum reservoir from data obtained or derived from observation wells and/or by drilling and logging new wells in swept areas of the petroleum reservoir;

determining a vertical displacement efficiency ($E_I$) of the petroleum reservoir from data obtained or derived from observation wells and/or by drilling and logging new wells in swept areas of the petroleum reservoir;

determining a pore displacement efficiency ($E_D$) of the petroleum reservoir from data obtained or derived from core samples taken from a plurality of locations throughout the petroleum reservoir;

determining, by relating together the areal displacement efficiency ($E_A$), vertical displacement efficiency ($E_I$), and pore displacement efficiency ($E_D$), a recovery efficiency (RE) of the petroleum reservoir;

determining, based on at least the pore displacement efficiency ($E_D$), an ideal recovery efficiency (IRE) for the petroleum reservoir; and determining, by relating the recovery efficiency (RE) with the ideal recovery efficiency (IRE), the recovery deficiency indicator (RDI) for the petroleum reservoir.

18. The method as claim 17, the pore displacement efficiency ($E_D$) of the petroleum reservoir being determined according to the following equation:

$$E_D=1-(S_{OR}/(1-S_{WC}))$$

wherein, $S_{OR}$=residual oil saturation, which is measured on one or more core samples after being flooded by a displacing fluid; and $S_{WC}$=water saturation of the one or more core samples at initial reservoir conditions.

19. The method as claim 18, the recovery efficiency (RE) of the petroleum reservoir being determined according to the following equation: $RE=E_A*E_I*E_D$.

20. The method as claim 19, the ideal recovery efficiency (IRE) of the petroleum reservoir being determined according to the following equation: $IRE=E_D$.

21. The method as claim 20, the recovery deficiency indicator (RDI) of the petroleum reservoir being determined according to the following equation: RDI=RE/IRE.

22. The method as in claim 17, further comprising using the production gain index (PGI) as part of a method for implementing a recovery plan for increasing recoverable petroleum reserves of the petroleum reservoir.

* * * * *

UNITED STATES PATENT AND TRADEMARK OFFICE

CERTIFICATE OF CORRECTION

PATENT NO. : 8,145,428 B1
APPLICATION NO. : 12/567361
DATED : March 27, 2012
INVENTOR(S) : Saleri et al.

It is certified that error appears in the above-identified patent and that said Letters Patent is hereby corrected as shown below:

Column 6
Line 65, change "weight some data" to --weigh some data--

Column 10
Line 44, change "an act or step of" to --an act or step 604 of--
Line 48, change "initial reservoir conditions;" to --initial reservoir conditions 606;--
Line 52, change "fluid);" to --fluid) 608;--
Line 53, change "displacement efficiency" to --displacement efficiency 610--

Column 11
Line 37, change "weight different" to --weigh different--

Signed and Sealed this
Second Day of October, 2012

David J. Kappos
*Director of the United States Patent and Trademark Office*